US005532438A

United States Patent [19]

Brown

[11] Patent Number: 5,532,438

[45] Date of Patent: Jul. 2, 1996

[54] ACOUSTIC IMAGING SOUND DOME

[76] Inventor: Kevin Brown, 341 Marlboro St., #2, Boston, Mass. 02115

[21] Appl. No.: 147,026

[22] Filed: Nov. 4, 1993

[51] Int. Cl.[6] ..... E04B 1/99

[52] U.S. Cl. ..... 181/155; 181/30

[58] Field of Search ..... 181/144, 155, 181/176, 30; 381/17, 64, 160

[56] References Cited

U.S. PATENT DOCUMENTS

| | | | |
|---|---|---|---|
| 1,120,858 | 12/1914 | Stallforth | 181/30 |
| 2,228,024 | 1/1941 | Abrahams . | |
| 2,643,727 | 6/1953 | Leon | 181/155 |
| 3,647,284 | 3/1972 | Elings . | |
| 3,776,361 | 12/1973 | Rolle . | |
| 3,832,888 | 9/1974 | Langlois . | |
| 3,895,188 | 7/1975 | Ingraham . | |
| 3,908,095 | 9/1975 | Jinsenji | 181/176 X |
| 4,421,200 | 12/1983 | Ferralli et al. | 181/144 |
| 4,629,030 | 12/1986 | Ferralli | 181/155 |
| 4,801,941 | 1/1989 | Sabet-Peyman . | |
| 4,836,328 | 6/1989 | Ferralli . | |
| 4,964,100 | 10/1990 | Srour et al. . | |
| 4,967,873 | 11/1990 | Hacchow et al. . | |
| 5,033,456 | 7/1991 | Pell et al. . | |
| 5,050,436 | 9/1991 | Kunii et al. . | |
| 5,199,075 | 3/1993 | Fosgate . | |
| 5,220,608 | 6/1993 | Pfister | 181/155 X |
| 5,268,539 | 12/1993 | Ono | 181/155 |

FOREIGN PATENT DOCUMENTS

| | | |
|---|---|---|
| 0500294 | 8/1992 | European Pat. Off. . |
| 3902062 | 7/1990 | Germany . |

OTHER PUBLICATIONS

Specification for Whispering Gallery at the Museum of Science and Industry (1973).

"Secret Sound®–The Unique Directional Speaker System", sales brochure from Museum Tools, at least by Apr., 1991.

*Primary Examiner*—Khanh Dang

*Attorney, Agent, or Firm*—Hamilton, Brook, Smith & Reynolds

[57] ABSTRACT

An acoustic imaging sound apparatus includes an acoustically reflective dome for reflecting and focusing stereophonic sound waves from stereo speakers directed into the interior of the dome. The stereophonic sound waves are focused by the dome to a listening area to provide a listener with pure stereophonic sound.

20 Claims, 4 Drawing Sheets

ACOUSTIC IMAGING SOUND DOME

BACKGROUND

Electro-acoustic speakers are used to generate sound, such as music or voice to a listener or listeners. Often, it is desirable for only a single person or a limited number of people to be capable of hearing a sound source so that others in nearby areas are not disturbed. This is useful if separate audiences located near each other are listening to more than one sound source such as when evaluating musical recordings for purchase in a music store, or listening to a display at a museum.

A common solution to this problem is to provide a single listener with headphones or multiple listeners with a listening booth. Headphones provide an isolated acoustic environment in which one can privately listen to a pure stereo sound source. Pure stereo sound provides sound from a right channel to the right ear and sound from a left channel to the left ear. A drawback with headphones is that the listener is inconvenienced with having to wear a headphone set.

Listening booths are typically an isolated room with stereo speakers which provides an isolated listening environment for one or more listeners. The drawback of listening booths is that the listening booth is completely isolated from surrounding regions by the walls of the listening booth. Additionally, the sound heard from stereo speakers in a listening booth is not pure stereo. Sound from both the right and left speakers or channels is heard by both the right and left ears.

SUMMARY OF THE INVENTION

Accordingly, there is a need for an apparatus for providing pure stereo sound to a listener without the inconvenience of wearing a headphone set, without disturbing people in the vicinity and without completely isolating the listening region from surrounding regions with walls.

The present invention provides an apparatus for focusing acoustic sound waves to a listener including an acoustically reflective dome having an interior surface for focusing acoustic sound waves. An acoustic sound wave generator is positioned in a first location with respect to the dome for producing acoustic sound waves. The sound waves are reflected off the interior surface of the dome and focused at a predetermined second location with respect to the dome for listening.

In preferred embodiments, the interior surface of the dome is substantially spherical in shape. The sound wave generator includes first and second speakers positioned side-by-side for producing stereophonic sound waves. The sound waves produced by the sound wave generator are equalized to boost the low frequency sound waves and reduce the high frequency waves in relation to the mid-range frequency sound waves. Optionally, a microphone can be positioned for receiving acoustic sound waves produced by the listener at the second location which are focused by the dome on the microphone. The microphone is helpful in voice-activated interactive applications where listener participation is required.

In another preferred embodiment of the present invention, the dome is substantially ellipsoidal in shape. A dome of such a shape is useful when a large dome with a shallow depth is desired.

The present invention apparatus provides isolated pure stereophonic sound to a listener without the inconvenience of wearing headphones and without completely isolating the listening region from surrounding regions with walls.

BRIEF DESCRIPTION OF THE DRAWINGS

The foregoing and other objects, features and advantages of the invention will be apparent from the following more particular description of preferred embodiments of the drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

Figure 1:
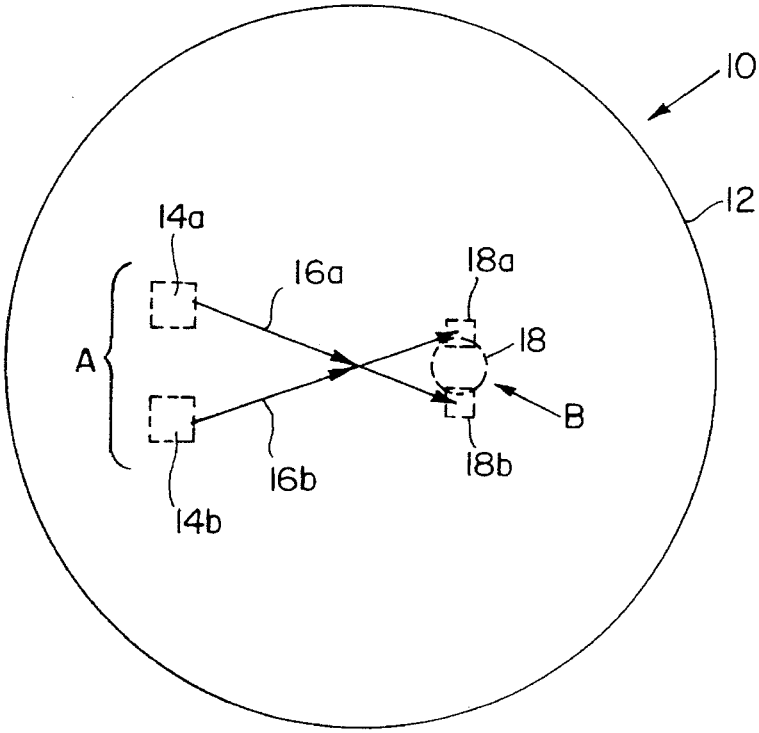
FIG. 1 is a top view of the present invention acoustic imaging sound dome.
Figure 2:
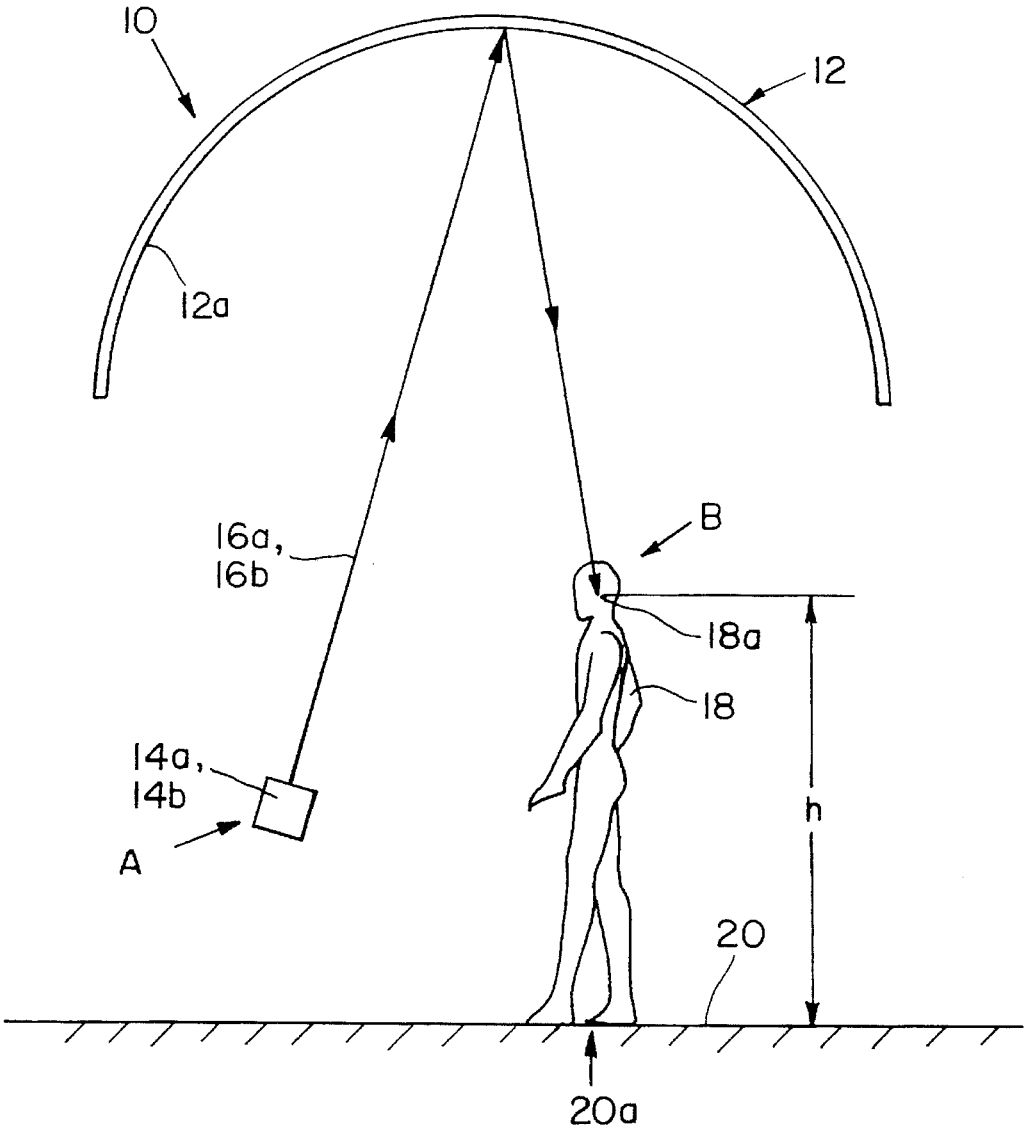
FIG. 2 is a side view of the present invention acoustic imaging sound dome.

In FIGS. 1 and 2, the present invention acoustic imaging sound dome apparatus 10 includes a spherical dome 12 made of acoustically reflective material which is positioned above a listener 18. By spherical dome, it is meant that the interior surface of the dome is spherical in curvature and does not mean that the dome itself has to be a complete sphere. A first speaker 14*a* and a second speaker 14*b* for producing sound are positioned at location "A". The first speaker 14*a* produces a first sound channel 16*a* and the second speaker 14*b* produces a second sound channel 16*b*. The first speaker 14*a* and the second speaker 14*b* direct the first and second sound channels 16*a* and 16*b* respectively into dome 12. Sound channels 16*a* and 16*b* are reflected by the interior surface 12*a* of dome 12 and focused on a listening area generally indicated at B. The sound channels cross each other before reaching listening area B. A listener 18 who wishes to listen to the stereophonic sound produced by speakers 14*a* and 14*b*, stands or sits at a designated location 20*a* which can consist of marks painted on floor 20. This positions the listener's 18 ears approximately in the region of listening area B. In the preferred embodiment, the height h at which listening area B is located is approximately 5'3" in height. This ensures that the majority of average height listeners will have their ears located approximately in the region of listening area B. The sound channel 16*a* produced by speaker 14*a* is focused by dome 12 at location 18*b* in the region about the left ear of listener 18. The sound channel 16*b* produced by speaker 14*b* is focused by dome 12 at location 18*a* in the region about the right ear of listener 18. As a result, since each ear hears sound produced by a different channel, pure stereophonic sound is heard by listener 18.

The sound frequencies which are reflected by dome 12 are generally between 500 hertz to 20,000 hertz. In most private listening applications, a 2½ foot to 5 foot diameter dome is suitable. However, larger diameters are possible. In the preferred embodiment, the dome 12 is made of rigid material secured to a frame with the interior surface of the dome coated with a plaster and fiberglass composite. However, alternatively, dome 12 can be made of any suitable uncoated rigid material such as cardboard, wood, metal or plastic. In addition, although dome 12 is shown as a full hemisphere, dome 12 can be less than a hemisphere.

Each speaker 14*a* and 14*b* produces a full range of audible frequencies from the same region in order for the sound for each channel 16*a* and 16*b* to be focused at a point. As a result, speakers having woofers and tweeters are not adequate speaker sources in this application because the woofer and tweeter are side-by-side. As a result, the sound from a woofer and tweeter would be focused side-by-side instead of at a single point. Since the sound from speakers 14*a* and 14*b* is focused, the high frequency sounds when heard at the listening area B have an increased intensity. The sound from speakers 14*a* and 14*b*, therefore, can be equalized in which the intensity of the bass or low frequency sound waves are boosted and the intensity of the high frequency sound waves reduced relative to the mid frequencies to balance the focused high frequencies.

Since the sound produced by speakers 14*a* and 14*b* is focused at points in space, the output of speakers 14*a* and 14*b* can be small compared to a conventional speaker placed in a room. When the listener's 18 ears are positioned within the region of listening area B, the ambient noise will be much less intense relative to the focused sound with only a moderate amount of structural isolation. Additionally, by carpeting the floor 20, further acoustic isolation is provided.

Figure 3:
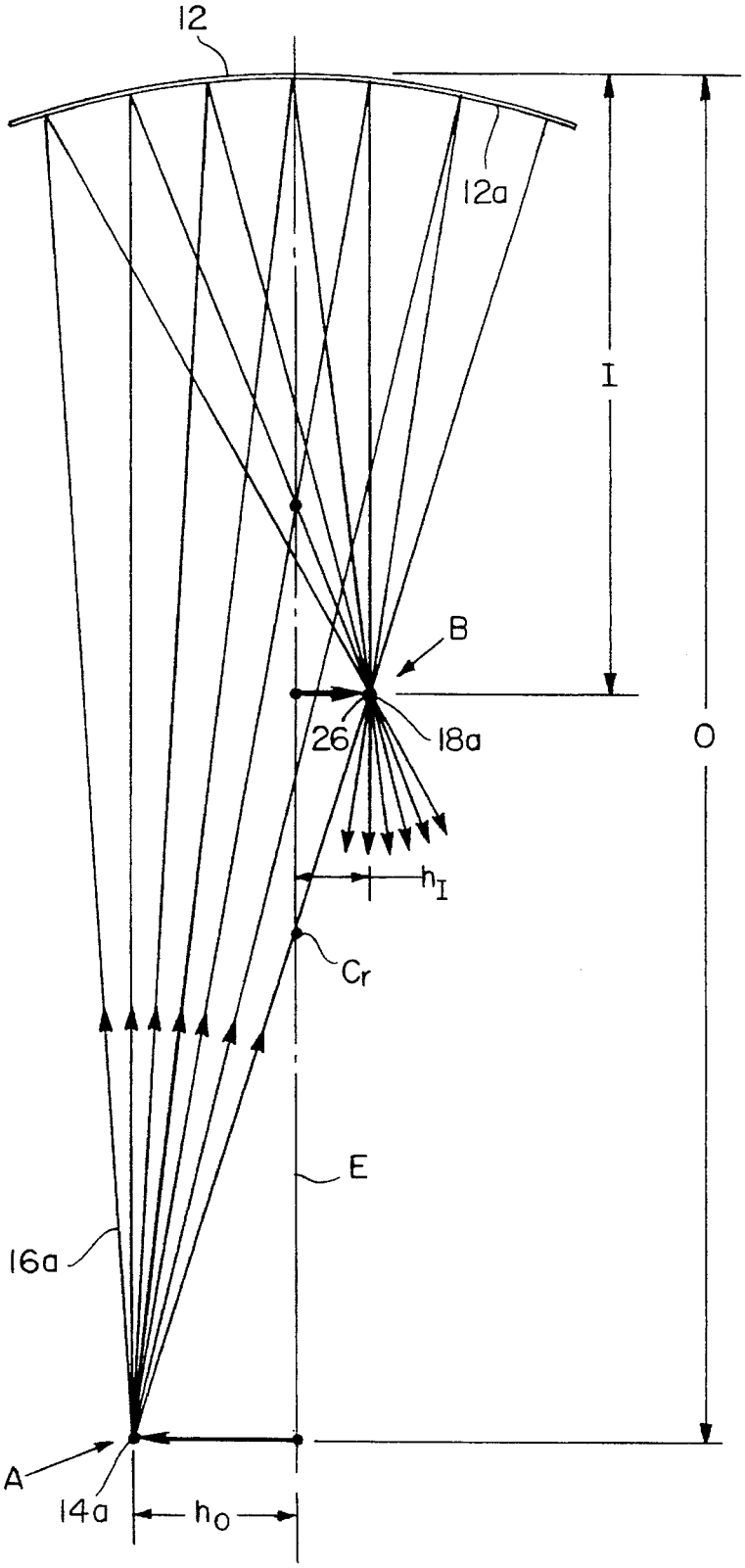
FIG. 3 is a graphical representation of a sound image at a first location focused by the acoustic imaging dome to a second location.

FIG. 3 depicts how sound produced by speaker 14*a* is reflected and focused. Although FIG. 3 depicts only how sound produced by speaker 14*a* is reflected and focused, the sound from speaker 14*b* is reflected and focused in the same manner. Dome 12 reflects and focuses sound waves in a manner that is similar to the way in which an optical spherical mirror focuses light. A sound channel 16*a* generated by a speaker 14*a* at location A is directed into dome 12 and reflected by the inner surface 12*a*. The sound from speaker 14*a* is focused on location 18*a* at listening area B to produce a focused sound image 26.

The vertical distances between the apex of dome 12 and focused sound image 26 or speaker 14*a* can be determined by the equation:

$$\frac{1}{O}+\frac{1}{I}=\frac{2}{r} \qquad \text{(Eq. 1)}$$

where:

O=the distance between speaker 14*a* and the apex of dome 12,

I=the distance between focused sound image 26 and the apex of dome 12, and r=the radius of curvature of dome 12 having $C_r$ as the center.

The horizontal distances between the vertical axis "E" and the focused sound image 26 or speaker 14*a* can be determined by the equation:

$$\frac{O}{I}=\frac{h_o}{h_I} \qquad \text{(Eq. 2)}$$

where:

$h_o$=the horizontal offset distance between speaker 14*a* and vertical axis "E", and $h_I$=the horizontal offset distance between focused sound image 26 and vertical axis "E", The size of the area occupied by focused sound image 26 is determined by the equation:

$$\frac{O}{I}=\sqrt{\frac{A_o}{A_I}} \qquad \text{(Eq. 3)}$$

where:

$A_o$=the area of speaker 14*a*, and $A_I$=the area occupied by focused sound image 26.

Figure 4:
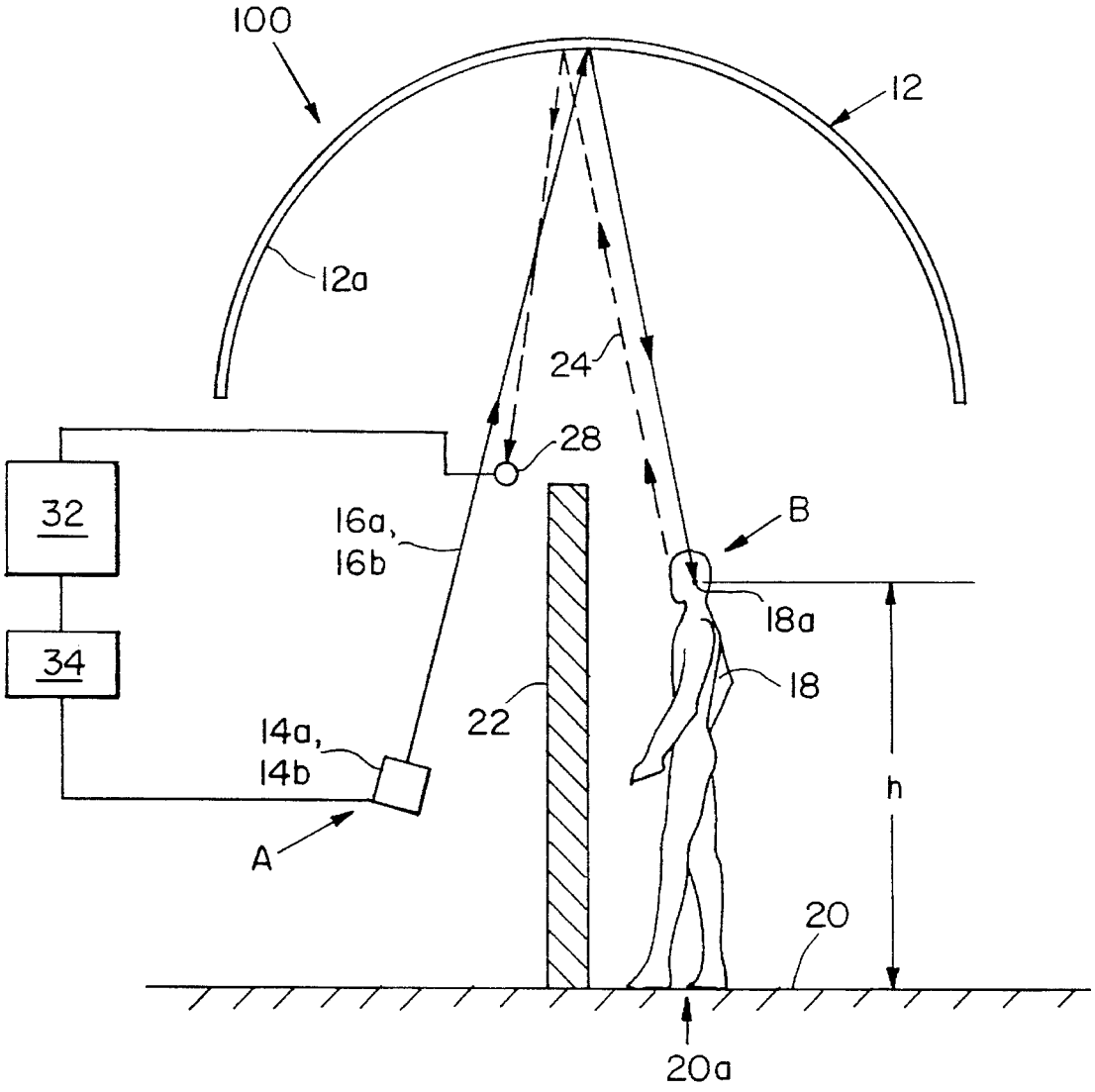
FIG. 4 is a side view of another preferred embodiment of the present invention acoustic imaging sound dome.

In FIG. 4, apparatus 100 is another preferred embodiment of the present invention in which a wall 22 is erected between the listener 18 and speakers 14*a* and 14*b*. Wall 22 is employed to hide the speakers from sight. The sound channels 16*a* and 16*b* generated by speakers 14*a* and 14*b* respectively travel above the wall 22. Sound channels 16*a* and 16*b* are reflected and focused by dome 12 over wall 22 to listening area B. A microphone 28 is positioned to receive the focused sound waves 24 reflected by dome 12 from words spoken by listener 18 for voice-activated interactive applications. In order for microphone 28 to receive the sound waves 24 from listener 18, listener 18 must stand at designated location 20*a* which places his/her head within listening area B. Microphone 28 is connected to a computer 32 which receives and processes the signals conveyed by microphone 28. Computer 32 can be operated by words spoken by listener 18 to control the sound generated by speakers 14*a* and 14*b*. A recorded music player 34 such as a turntable, tape player or compact disc player can be coupled to computer 32. Additionally, other walls may be erected to partially or fully enclose listening post B to provide further acoustic isolation.

In other applications, dome 12 can be used for speaking and listening to a person over the telephone. Dome 12 can also focus the audio portion of a television program to a viewer watching television so that people nearby are not disturbed. Additionally, apparatus 100 can have multiple speaker locations and corresponding listening areas. Furthermore, although two speakers are shown for producing stereophonic sound, a single speaker can be employed to provide monotone sound.

Figure 5:
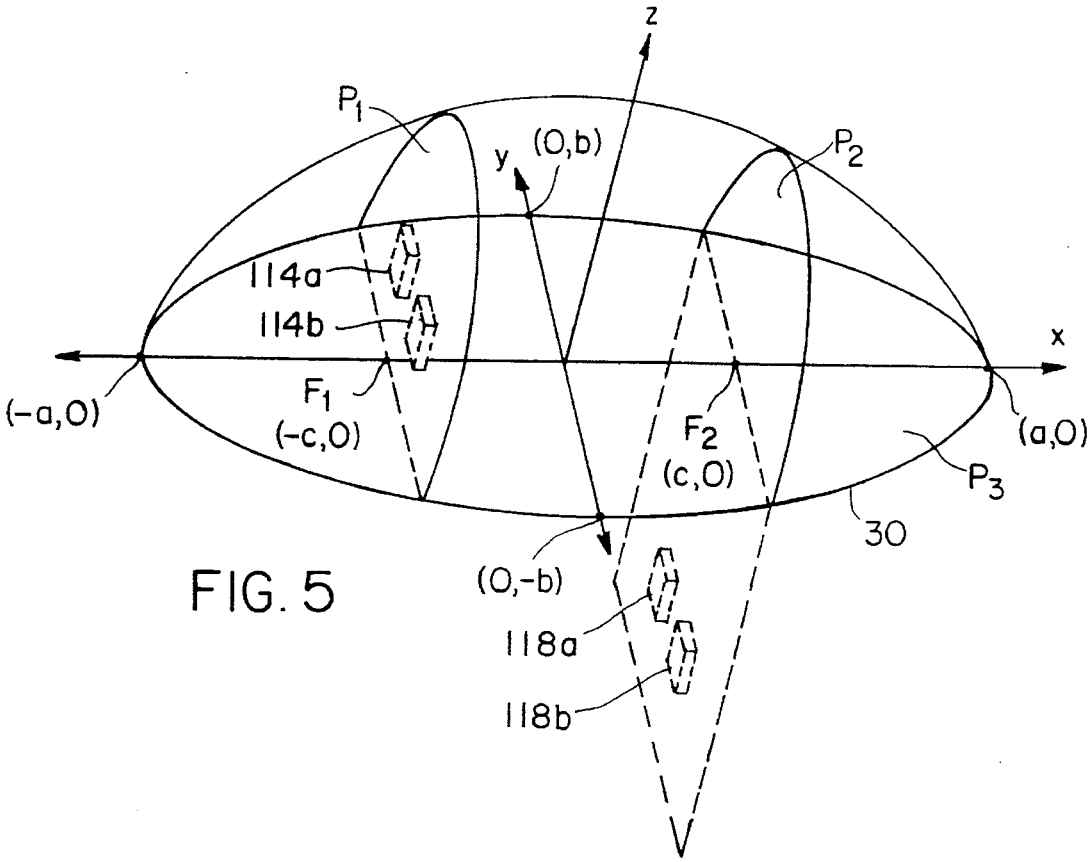
FIG. 5 is a perspective view of another preferred embodiment of the present invention dome.

FIG. 5 depicts a dome 30 which can be substituted for dome 12. By specifying an ellipsoidal dome, it is meant that the interior surface of the dome is ellipsoidal in curvature and does not mean that the dome itself has to be a complete ellipsoid. Dome 30 is ellipsoidal in shape. An ellipsoidal dome 30 is useful in applications where a large dome with a shallow depth is desired.

Dome 30 has two focii $F_1$ and $F_2$ located near respective ends of dome 30 along the elliptical x-y plane $P_3$. The equation of an ellipse with focii $F_1$ and $F_2$ located at $F_1$=(−c,O) and $F_2$=(c,O) is:

$$\frac{X^2}{a^2}+\frac{Y^2}{b^2}=1 \qquad \text{(Eq. 4)}$$

where:

a=the semimajor axis b=the semiminor axis, and $a^2=b^2+c^2$

In use, speakers 114*a* and 114*b* are positioned within dome 30 along the y-z plane $P_1$ which passes through foci $F_1$. The sound produced by speakers 114*a* and 114*b* is reflected by dome 30 and focused at locations 118*a* and 118*b* located outside dome 30 on the y-z plane $P_2$ passing through foci $F_2$. The sound produced by speaker 114*a* is focused at location 118*b*, which crosses the sound produced by speaker 114*b* focused at location 118*a*. The sound images focused on locations 118*a* and 118*b* are the same as the source. Locations 118*a* and 118*b* are located an equal distance away from the x axis as speakers 114*a* and 114*b* but on the opposite side.

EQUIVALENTS

While this invention has been particularly shown and described with references to preferred embodiments thereof, it will be understood by those skilled in the art that various changes in form and details may be therein without departing from the spirit and scope of the invention as defined by the dependent claims.

What is claimed is:

1. An apparatus for focusing sound waves to a listener comprising:

an acoustically reflective dome having an interior surface for focusing sound waves, the interior surface of the dome being spherical in shape with a constant radius; and a sound wave generator positioned in a first location with respect to the dome for producing sound waves, the sound waves reflecting off the interior surface of the dome and focusing at a predetermined second location with respect to the dome for listening, whereby the location at which the sound waves are focused can be varied by varying the location at which the sound waves are produced.

2. The apparatus of claim 1 in which the sound wave generator comprises first and second speakers positioned side-by-side for producing stereophonic sound waves.

3. The apparatus of claim 2 in which the sound waves produced by the sound wave generator are equalized.

4. The apparatus of claim 1 further comprising a microphone positioned for receiving sound waves produced by the listener at the second location and focused on the microphone by the dome.

5. The apparatus of claim 1 in which the dome has an apex and a radius of curvature r, wherein the first location is at a distance "0" from the apex, and wherein the second location is at a distance "I" from the apex such that:

$$\frac{1}{O}+\frac{1}{I}=\frac{2}{r}.$$

6. The apparatus of claim 5 in which the sound wave generator has a sound wave generating area of $A_o$ and in which the sound waves are focused in an area $A_I$, and wherein:

$$\frac{O}{I}=\sqrt{\frac{A_o}{A_I}}.$$

7. The apparatus of claim 5 in which the dome has a central axis, the first location being offset from the central axis a distance $h_o$ and the second location being offset from the central axis a distance $h_I$ and wherein:

$$\frac{O}{I}=\frac{h_o}{h_I}.$$

8. An apparatus for focusing sound waves to a listener comprising:

an acoustically reflective dome having an interior surface for focusing sound waves, the interior surface of the dome including a spherical section having an apex and a constant radius; and a sound wave generator positioned in a first location with respect to the dome for producing sound waves, the sound waves reflecting off the interior surface of the dome and focusing at a predetermined second location with respect to the dome for listening, where one of the first and second locations is at a distance from the apex that is less than the radius and the other of the first and second locations is at a distance from the apex that is greater than the radius.

9. An apparatus for focusing sound waves to a listener comprising:

an acoustically reflective dome having an interior surface for focusing sound waves, the interior surface of the dome having a constant radius; and a sound wave generator positioned in a first location with respect to the dome for producing sound waves, the sound waves reflecting off the interior surface of the dome and focusing at a predetermined second location with respect to the dome for listening, whereby the location at which the sound waves are focused can be varied by varying the location at which the sound waves are produced.

10. An apparatus for focusing sound waves to a listener comprising:

an acoustically reflective dome for focusing sound waves, the dome having an interior surface which is spherical in shape with a constant radius; and a sound wave generator comprising first and second speakers positioned side-by-side in a first location with respect to the dome for producing stereophonic sound waves, the stereophonic sound waves reflecting off the interior surface of the dome and focusing in stereo at a predetermined second location with respect to the dome for listening, whereby the location at which the sound waves are focused can be varied by varying the location at which the sound waves are produced.

11. The apparatus of claim 10 in which the sound waves produced by the sound wave generator are equalized.

12. The apparatus of claim 10 further comprising a microphone positioned for receiving sound waves produced by the listener at the second location and focused on the microphone by the dome.

13. An apparatus for focusing sound waves comprising:

an acoustically reflective dome having an interior surface for focusing sound waves, the interior surface of the dome being spherical in shape with a constant radius;

a sound wave generator positioned in a first location with respect to the dome for producing sound waves, the sound waves reflecting off the interior surface of the dome and focusing at a predetermined second location with respect to the dome for listening, whereby the location at which the sound waves are focused can be varied by varying the location at which the sound waves are produced; and a microphone positioned in a third predetermined location with respect to the dome for receiving sound waves generated from the second predetermined location with respect to the dome, the generated sound waves reflecting off the interior surface of the dome and focusing on the microphone.

14. A method of focusing sound waves to a listener comprising the steps of:

providing an acoustically reflective dome having an interior surface for focusing sound waves, the interior surface of the dome being spherical in shape with a constant radius;

positioning a sound wave generator for producing sound waves in a first location with respect to the interior surface of the dome; and reflecting the sound waves produced by the sound wave generator with the interior surface of the dome to focus the sound waves at a predetermined second location with respect to the dome for listening, whereby the location at which the sound waves are focused can be varied by varying the location at which the sound waves are produced.

15. The method of claim 14 in which the sound wave generator comprises first and second speakers positioned side-by-side for producing stereophonic sound waves.

16. The method of claim 15 further comprising the step of equalizing the sound waves generated by the sound wave generator.

17. The method of claim 14 further comprising positioning a microphone for receiving sound waves produced by the listener at the second location and focused on the microphone by the dome.

18. A method of focusing sound waves to a listener comprising the steps of:

providing an acoustically reflective dome for focusing sound waves, the dome having an interior surface which is spherical in shape with a constant radius;

positioning a sound wave generator for producing stereophonic sound waves in a first location with respect to the interior surface of the dome, the sound wave generator comprising first and second speakers positioned side-by-side; and reflecting the stereophonic sound waves produced by the sound wave generator with the interior surface of the dome to focus the sound waves at a predetermined second location with respect to the dome for listening, whereby the location at which the sound waves are focused can be varied by varying the location at which the sound waves are produced.

19. The method of claim 18 further comprising the step of equalizing the sound waves generated by the sound wave generator.

20. The method of claim 18 further comprising positioning a microphone for receiving sound waves produced by the listener at the second location and focused on the microphone by the dome.

* * * * *